US007611301B2

(12) United States Patent
Gueret

(10) Patent No.: US 7,611,301 B2
(45) Date of Patent: Nov. 3, 2009

(54) APPLICATOR DEVICE

(75) Inventor: Jean-Louis Gueret, Paris (FR)

(73) Assignee: L'Oreal (FR)

( * ) Notice: Subject to any disclaimer, the term of this patent is extended or adjusted under 35 U.S.C. 154(b) by 53 days.

(21) Appl. No.: 10/475,461

(22) PCT Filed: Apr. 22, 2002

(86) PCT No.: PCT/FR02/01377

§ 371 (c)(1),
(2), (4) Date: Aug. 23, 2004

(87) PCT Pub. No.: WO02/085733

PCT Pub. Date: Oct. 31, 2002

(65) Prior Publication Data

US 2005/0042018 A1 Feb. 24, 2005

(30) Foreign Application Priority Data

Apr. 20, 2001 (FR) ..... 01 05390

(51) Int. Cl.
*A45D 33/00* (2006.01)

(52) U.S. Cl. ..... 401/130

(58) Field of Classification Search ..... 401/118, 401/119, 123–126, 130
See application file for complete search history.

(56) References Cited

U.S. PATENT DOCUMENTS

| | | | | |
|---|---|---|---|---|
| 1,063,484 | A * | 6/1913 | Weismantel | 401/102 |
| 1,172,293 | A | 2/1916 | Kohlhepp | |
| 1,581,563 | A * | 4/1926 | Brown | 401/262 |
| 1,936,361 | A * | 11/1933 | Kaufmann | 401/152 |
| 4,089,609 | A * | 5/1978 | Gring et al. | 401/130 |
| 4,772,148 | A * | 9/1988 | Buschemeyer | 401/206 |
| 5,492,426 | A | 2/1996 | Gueret | |
| 5,636,931 | A | 6/1997 | Gueret | |
| 6,045,279 | A * | 4/2000 | Follis | 401/6 |

FOREIGN PATENT DOCUMENTS

| | | |
|---|---|---|
| CN | 1154225 | 7/1997 |
| CN | 1270131 | 10/2000 |
| DE | 84 02 292 A1 | 9/1984 |
| EP | 1 086 904 A1 | 3/2001 |
| FR | 2798646 A1 | 3/2001 |
| GB | 174983 A1 | 2/1922 |
| JP | 46-24584 | 8/1971 |
| JP | 47-28797 | 8/1972 |
| JP | 49-35860 | 3/1974 |
| JP | 49-76866 | 7/1974 |
| JP | 59-1314 | 1/1984 |
| JP | 64-43816 | 3/1989 |

(Continued)

*Primary Examiner*—Huyen Le
(74) *Attorney, Agent, or Firm*—Lerner, David, Littenberg, Krumholz & Mentlik, LLP

(57) ABSTRACT

The present invention relates to a device for applying a substance, in particular a cosmetic. The device comprising a support, a compressible applicator member mounted securely to a face of the support, and having a peripheral edge with at least a portion thereof situated at a distance from the face of the support, the applicator member being fastened to the support by a fastening zone that extends at a distance from a peripheral edge of the face of the support.

35 Claims, 5 Drawing Sheets

FOREIGN PATENT DOCUMENTS

| | | |
|---|---|---|
| JP | 50-35468 | 2/1993 |
| JP | 51-31954 | 5/1993 |
| JP | 7-303588 | 11/1995 |
| JP | 2000-202354 | 7/2000 |
| JP | 2000-354514 | 12/2000 |
| JP | 2001-70224 | 3/2001 |

* cited by examiner

APPLICATOR DEVICE

BACKGROUND OF THE INVENTION

The present invention relates to devices for applying a substance, in particular a cosmetic, and more particularly but not exclusively it relates to devices for applying a substance over a large area of the body or the face.

Numerous applicator devices comprising a support and an applicator member fixed to the support are known from FR 2 798 646, U.S. Pat. Nos. 1,172,293, 5,492,426, and 5,636,931.

In particular, applicator devices are known that comprise an applicator member fixed to a support that also serves as a handle member and as a closure member for a receptacle. In some of those devices, the applicator member is fixed via a plane face to a wall of the support that is likewise plane. In others, the applicator member comprises a layer of foam covering a block of elastomer material.

There exists a need in particular to improve application comfort.

In a first aspect, the present invention provides a device for applying a substance, in particular a cosmetic, the device comprising: a support; a compressible applicator member mounted in a fixed manner on a face of the support and having a peripheral edge at least a portion of which is situated at a distance from the face, the applicator member being fastened to the support via a fastening zone that extends at a distance from the peripheral edge of the face.

In a second aspect, the present invention provides a device for applying a substance, in particular a cosmetic, the device comprising: a support; and a compressible applicator member mounted in fixed manner on a face of the support and having a peripheral edge, at least a portion of which is situated at a distance from the face. A cross-section of the face having an area greater than or equal to the area defined inside the peripheral edge.

In a third aspect, the present invention provides a device for applying a substance, in particular a cosmetic, the device comprising: a support presenting a first face; and a compressible applicator member having a second face fastened to the first face, the second face having a profile different from the profile of the first face so that a portion of a peripheral edge of the second face is at a distance from the first face.

In a fourth aspect, the present invention provides a device for applying a substance, in particular a cosmetic, the device comprising: a support; and a compressible applicator member having a shape that is generally flat transversely to an axis the applicator member comprising: at least a first portion fastened to the support; and at least a second portion spaced apart from the support, co-operating therewith when the applicator member is not compressed to define at least an acute angle in a plane containing the axis and forming an outwardly-open empty space enabling it to bend towards the support during application.

According to a characteristic of the present invention, the angle may be acute and the second portion creates a void defined by the support and the applicator member. The void opens out to the outside and enables the second portion to bend towards the support during application. The possibility of the second portion of the applicator member that is spaced apart from the support bending towards the support during application enables the applicator member to match its shape gently to any change in surface relief during application. This increases the comfort of application.

The way in which the product is spread can also be different from that which is obtained with a prior art applicator device that does not have any flexible peripheral lip.

The second portion may be suitable for bearing at least in part against the support during application.

By way of example, the applicator member may be generally disk-shaped, being circularly symmetrical or otherwise.

Facing the support, the second portion may present a surface that is outwardly convex. The applicator member and the support may define an annular void adjacent to the point where they contact one another.

The first portion may be situated substantially in the center of a face of the applicator member disposed facing the support.

The applicator member may be fixed in a non-removable manner to the support. In a variant, the applicator member may alternatively be fixed in a removable manner to the support. For example, the applicator member may be fixed to the support by mechanical hooking of the Velcro® type such as by hooks and loops.

The applicator member may present an application face that is generally convex, generally concave, or indeed substantially plane, for example.

The applicator member may have no housing for receiving a supply of substance, and in particular when the applicator member comprises a cellular material, it may have no housing of size greater than that of the cells.

The second portion may be more flexible than the support. The applicator member may present a flocked face for application purposes, thereby making it easier to load it with substance and making application softer. The applicator member may comprise at least two layers of foam assembled together. The applicator member may include at least one inside cavity filled with air, giving flexibility to the applicator member. The two above-mentioned layers of foam may be assembled together in such a manner as to form the cavity between them. The two layers of foam may be assembled together by heat-sealing, in particular. At least one of the two layers of foam may be flocked on the outside.

Making the applicator member by assembling together layers of foam may serve to give the applicator member a periphery with a rounded shape. It is possible to use layers of foam that are initially plane.

The foams used for making the applicator member may be flocked while they are flat, prior to being cut out and assembled together to form the applicator member, thus making it easier to obtain high quality flocking.

The support may include a rigid portion on which the applicator member is fixed. This rigid portion may comprise a sintered piece, for example.

The support may also include a flexible portion on which the applicator member is fixed. By way of example, the flexible portion may comprise a compressible element which may comprise at least one layer of foam and/or may be internally hollowed out, for example.

The flexible portion may also comprise an elastomer wall.

The support may present a face on which the applicator member is secured, which face may have various shapes.

For example, the support may present a face that is substantially plane, to which the applicator member is secured. The support may also present a face that is generally outwardly convex, to which the applicator member is secured. The support may include a solid or a hollow portion to which the applicator member is secured.

The applicator member may present a maximum thickness measured along the axis that is no greater than one-third the greatest dimension of the applicator member measured perpendicularly to the axis. The greatest dimension corresponds, for example, to its greatest diameter if the applicator member is circularly symmetrical. The above-defined acute angle may be less than or equal to 60°, for example.

By way of example, the maximum distance over which the second portion can be cantilevered-out and as measured perpendicular to the axis may be greater than or equal to one-seventh or even one-fourth of the greatest dimension of the applicator member as measured perpendicularly to the axis.

The support may be configured to serve as a closure member for a receptacle containing the substance, e.g. a substantially leaktight closure member.

The support may include at least one substance feed orifice.

The present invention may also provide a device for packaging and applying a substance, in particular a cosmetic. The device comprises a receptacle containing the substance together with an applicator device as defined above.

The applicator member may optionally be compressed when the receptacle is closed. The applicator device may be configured to close the receptacle in a substantially leaktight manner.

The applicator member may come into contact with a sieve when the receptacle is closed.

The applicator device may optionally be secured to the receptacle while application is taking place.

In another of its aspects, the present invention also provides an applicator member having at least two assembled-together layers of foam, one of the layers optionally being flocked. Both layers may be flocked on the outside. The two layers may be assembled together at their periphery by heat-sealing, in particular.

In another of its aspects, the present invention provides an applicator member comprising at least two layers of foam assembled together at their periphery and defining between them a cavity filled with air.

In another of its aspects, the present invention provides a device for applying a substance, in particular a cosmetic, the device comprising: a support; a compressible applicator member fastened to the support without being able to retract into the inside thereof, having a general shape that is flattened transversely to an axis. The applicator member comprises: at least a first portion fastened to the support; and at least a second portion outside the first portion and spaced apart from the support. The maximum distance measured perpendicularly to the axis over which the second portion is cantilevered-out may be greater than or equal to one-seventh or even one-fourth of the greatest dimension of the applicator member measured perpendicularly to the axis.

In another of its aspects, the present invention may also provide a device for applying a substance, in particular a cosmetic, the device comprising: a support; and a compressible applicator member having an outside surface that is flocked at least in part. The compressible applicator member comprising: at least a first portion fastened to the support; and at least an outer second portion spaced apart from the support and co-operating therewith when the applicator member is not compressed to define an empty space enabling it to bend towards the support during application.

In another of its aspects, the present invention may provide a device for applying a substance, in particular a cosmetic, the device comprising: a support; and a compressible applicator member, comprising: at least a first portion fastened to the support; at least an outer second portion spaced apart from the support; and an internal cavity filled with air.

BRIEF DESCRIPTION OF THE DRAWINGS

The present invention can be better understood on reading the following detailed description of non-limiting embodiments of the invention, and on examining the accompanying drawings, in which.

DETAILED DESCRIPTION

Figure 1:
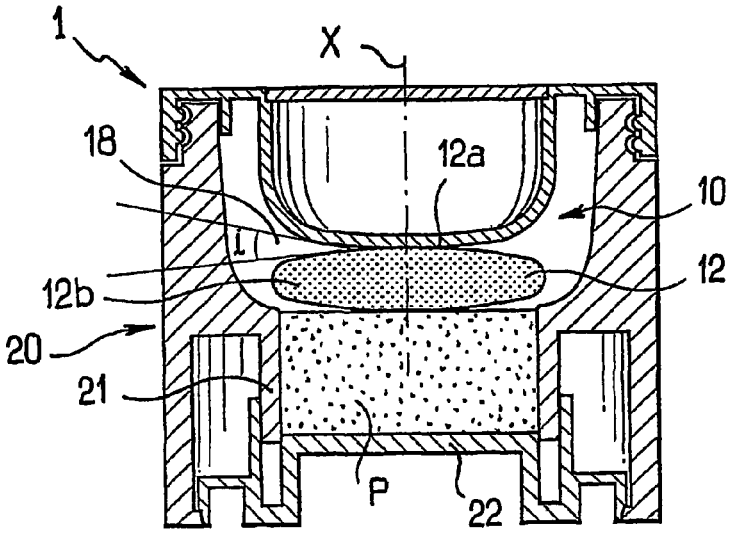
FIG. 1 is a diagrammatic axial section view of an embodiment of the device of the present invention.

FIG. 1 shows a packaging and applicator device constituting a first embodiment of the present invention. This device 1 comprises an applicator device 10 shown in isolation in FIG. 2, and a receptacle 20 comprising a body 21 housing a supply of a substance P, for example a compacted powder.

The receptacle 20 may have a moving bottom 22 enabling the substance to be raised as the substance is used up.

The invention is not restricted to any particular substance and it applies to all cosmetics and care products, such as powders, pastes, creams, gels, etc.

The term "cosmetic" is used to mean a product as defined by EEC Directive 93/35 of Jun. 14, 1993 amending EEC Directive 76/766 for the sixth time.

The applicator device 10 comprises a support 11 and a compressible applicator member 12 fixed to the support 11. The applicator member 12 is generally flat in shape, being disk-shaped about an axis X in the example shown. Its thickness h measured along the axis X is considerably smaller than its greatest diameter m. In the example shown, the support 11 also serves as a handle member and as a closure member for the receptacle 10, and for this purpose it has a threaded skirt 14 suitable for screwing onto a corresponding thread of the body 21 of the receptacle, and it also has a sealing lip 15.

The applicator member 12 is fixed on a wall 16 of the support which, in the example shown, is made integrally with the threaded skirt 14 and the sealing lip 15.

In the example shown, the wall 16 is rigid and presents an outside surface 17 that is convex, however it would not go beyond the scope of the present invention for the portion of the support on which the applicator member is fastened to be non-rigid and/or to present some other shape, as shown below.

Figure 3:
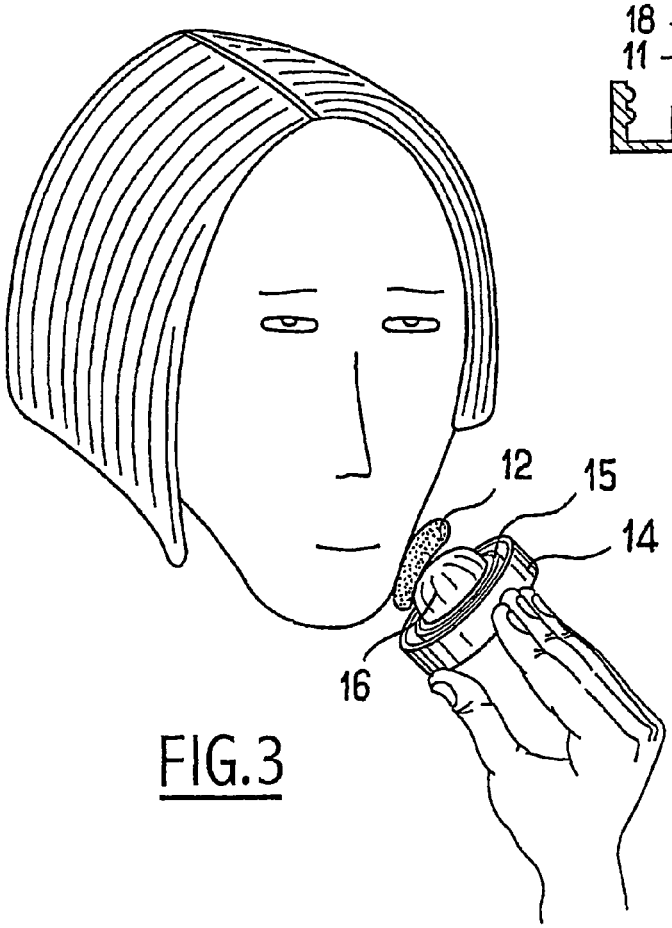
FIG. 3 shows the applicator member deforming while it is in use.

The applicator member 12 presents a first portion 12*a* fastened to the top of the surface 17, and a second portion 12*b* surrounding the first and spaced apart from the wall 16, co-operating therewith to leave an annular groove 18 which enables at least part of the second portion 12*b* to bend towards the support while a substance is being applied, as shown in FIG. 3. In FIG. 1, it can be seen that, in the absence of compression on the applicator member 12, the angle i formed between the surface 17 and the second portion 12*b* is an acute angle. The surface 19 of the portion 12*b* facing the wall 16 is convex. The convex shape of the surface 17 serves to increase the travel of the portion 12*b* in use. The portion 12*b* in the example described is suitable for coming at least in part to bear against the wall 16, as can be seen in FIG. 3.

Figure 2:
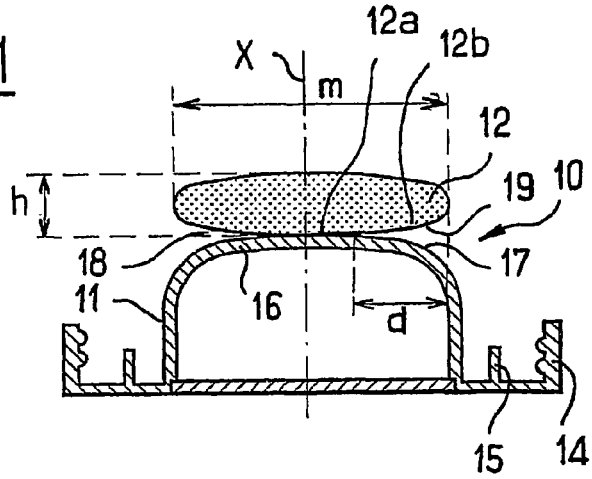
FIG. 2 shows the applicator device of FIG. 1 in isolation.

The distance d over which the portion 12*b* is cantilevered-out from the wall 16 can be relatively large, as can be seen in FIG. 2, so as to impart a high degree of flexibility to the peripheral region of the applicator member.

When the applicator device 10 is put into place on the receptacle 20, the applicator member 12 may be compressed or not compressed. It can be seen in FIG. 1 that the applicator element does not retract into the support.

With reference to FIGS. 4 to 17, there follows a description of various configurations for the applicator member, with the present invention not being limited thereto.

Figure 4:
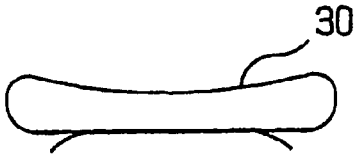
FIGS. 4 to 12 show various configurations, amongst others, for the applicator member.
Figure 5:
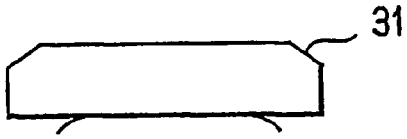
Figure 6:
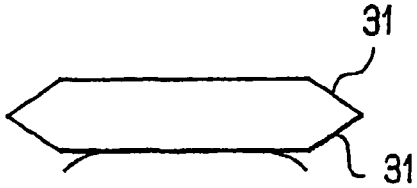
Figure 7:
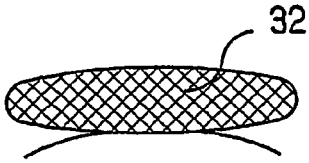
Figure 8:
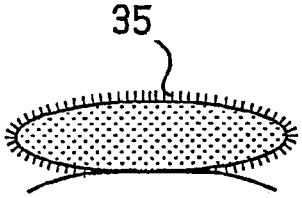
Figure 9:
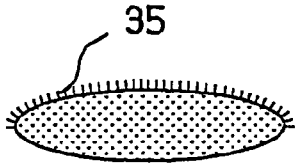

The surface of the applicator member used for application may present a shape other than a convex shape, without thereby going beyond the scope of the present invention. In particular, it may present a generally concave shape, as shown in FIG. 4, or a substantially plane shape, as shown in FIG. 5. The applicator member may be machined and include, for example, one or two chamfers 31, as shown in FIGS. 5 and 6. The applicator member may carry woven or non-woven cloth 32 on its surface, as shown in FIG. 7. The applicator member may include flocking 35 extending over all or part of its surface, as shown in FIGS. 8 and 9.

The applicator member may comprise an elastically deformable foam, e.g. a foam having open or semi-open cells, in particular a foam selected from polyurethane foams, polyethylene foams, polyvinyl chloride foams, amongst others.

Figure 10:
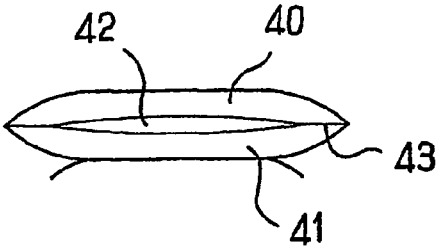

As can be seen in FIG. 10, the applicator member may be made as two layers of foam 40 and 41 having edges 43 that are assembled together in the peripheral region of the applicator member, by heat-sealing, for example. The use of two layers of foam makes it easy to implement an air-filled cavity 42 inside the applicator member, thereby imparting increased flexibility to the applicator member. When a plurality of layers of foam are used to make the applicator member, the foam(s) used can be made of materials that are different and/or that present cells having a variety of sizes, and in particular it is possible to use foams having very fine cells. The cavity presents a size which is much greater than the size of the cells of the layer(s) of foam used. Using two layers of foam can also make it easier to obtain an applicator member with flocking of good quality.

Figure 11:
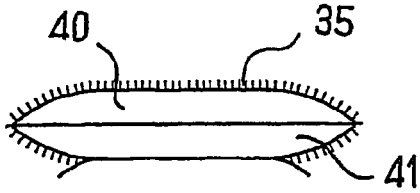
Figure 12:
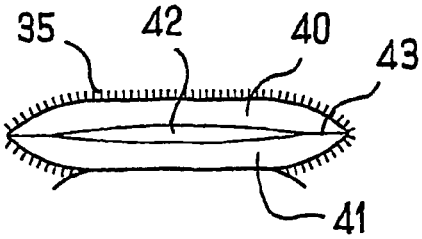

At least one of the two layers of foam may be flocked while the foam is flat prior to being cut out, thereby making it possible to obtain flocking that is relatively uniform over its surface. After flocking, the layer of foam can be assembled with another layer of foam that is flocked or not flocked, and the foam can optionally define an internal cavity 42 as shown in FIGS. 11 and 12. The operations of cutting out and assembling together the layers of foam may be performed at a single workstation or at two workstations that are very close together in a manufacturing line, for example.

Figure 13:
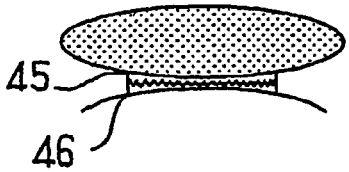
FIG. 13 shows the applicator member being fastened in a removable manner.

The applicator member may be fastened to the support in various ways. The applicator member may be fastened in a non-removable manner, by an adhesive or heat-sealing, for example. The applicator member may also be fastened to the support in a removable manner, e.g. by means of a Velcro® type fastening, as shown in FIG. 13, the fastening comprising two portions 45 and 46 suitable for co-operating with each other by mechanical hooking, one of the portions comprising loops and the other hooks suitable for hooking onto the loops, for example, the two portions 45 and 46 being secured respectively to the applicator member and to the support.

In a variant of the present invention, one of the portions may be replaced by a covering of woven or non-woven cloth constituting the loops, for example, and present on the surface of the applicator member.

The applicator member may also be fastened by means of an adhesive selected so as to enable it to be unstuck without tearing the applicator member from its support, merely by exerting sufficient force, e.g. for the purpose of enabling the user to replace one applicator member with another. The two layers of foam used may be identical or otherwise.

Prior to fastening the applicator member on the support, the applicator member may have the shape of a disk, optionally circularly cylindrical about the axis X, having two opposite faces that are outwardly convex or that present other shapes.

There follows a description with reference to FIGS. 14 to 22 of various embodiments of supports to which any one of the above-described applicator members can be fastened, optionally in a removable manner.

Figure 14:
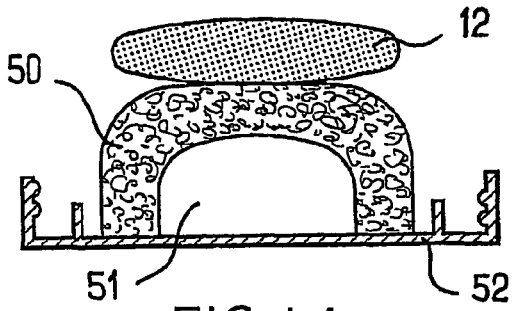
FIGS. 14 to 20 show various configurations, amongst others, for the support.
Figure 15:
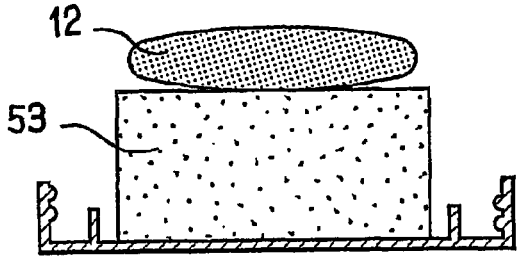
Figure 16:
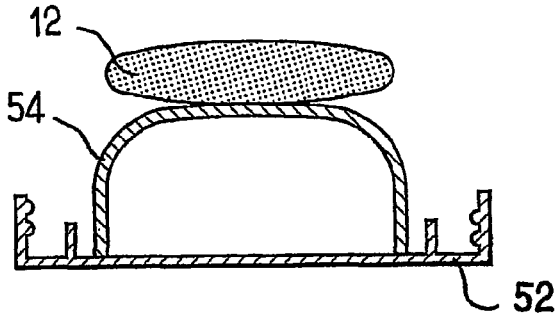
Figure 17:
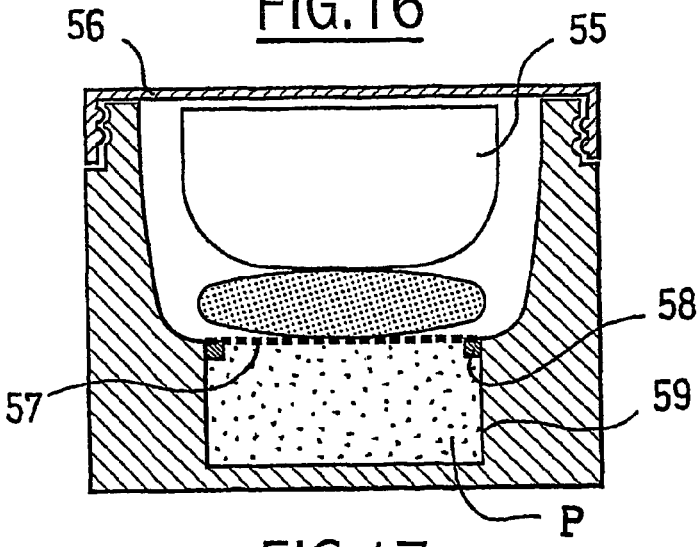

The support may include a flexible portion 50 as shown in FIG. 14. The flexible portion is constituted, for example, by a block of foam that is hollowed out in its central region 51 and fastened to a lid 52 on its side remote from the applicator member 12.

The flexible portion 50 may comprise a compressible material, for example an open-celled or semi-open celled foam of polyurethane, polyethylene, polyvinyl chloride, polyester, polyether, polyethylene-vinyl acetate copolymer, polyvinyl acetate, natural or synthetic rubber, this list not being limiting.

The support may also comprise a flexible or rigid sintered piece 53. The sintered piece may be constituted in particular by sintering a flexible material, in particular selected from elastomers, thermoplastic elastomers, polyvinyl chlorides, and polyethylene-vinyl acetate copolymers.

The applicator member 12 may also be fastened to a wall 54 made of an elastomer, for example a wall fitted on the lid 52. This wall 54 may be similar in shape to the above-described wall 16, for example.

The support may include a portion enabling it to be fastened to the receptacle, as is the case in particular of the embodiments shown in FIGS. 1 and 14 to 16. However, it would not go beyond the scope of the present invention for the support to be independent of a lid for closing the receptacle, as is the case, for example, for the device of FIG. 17. It can be seen in this figure that the support comprises an element 55 which serves as a handle and which is independent of the lid 56 used for closing the receptacle.

By way of example, the receptacle may include a sieve 57 fixed on a ring 58 suitable for engaging in the housing 59 containing the substance P and moving down progressively as the substance is consumed.

Figure 18:
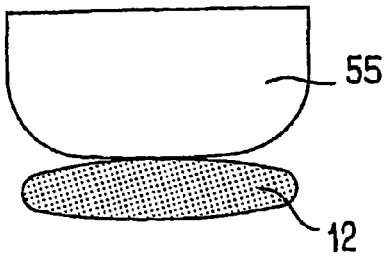
Figure 19:
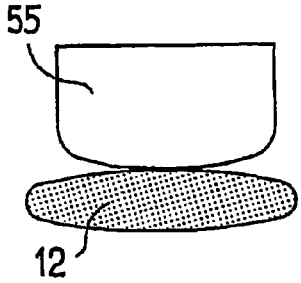
Figure 20:
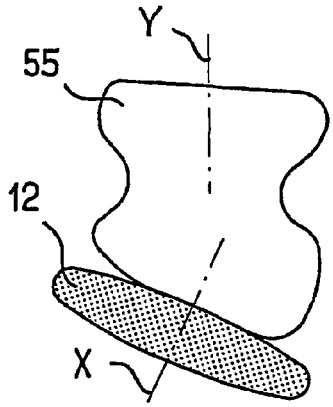

The element 55 may be given various shapes, such as those shown in FIGS. 18 to 20, and in particular it may have an axis X that is not parallel to the longitudinal axis Y of the element 55.

The element 55 may present a dimension measured perpendicularly to its longitudinal axis that is optionally greater than the greatest dimension measured perpendicularly to the axis X of the applicator member, as shown in FIGS. 18 and 19.

Figure 21:
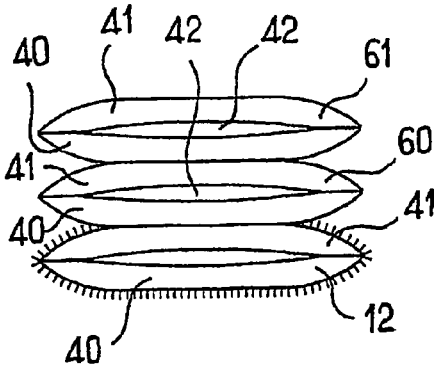
FIGS. 21 and 22 are diagrammatic views of applicator devices comprising superposed flexible disks.
Figure 22:
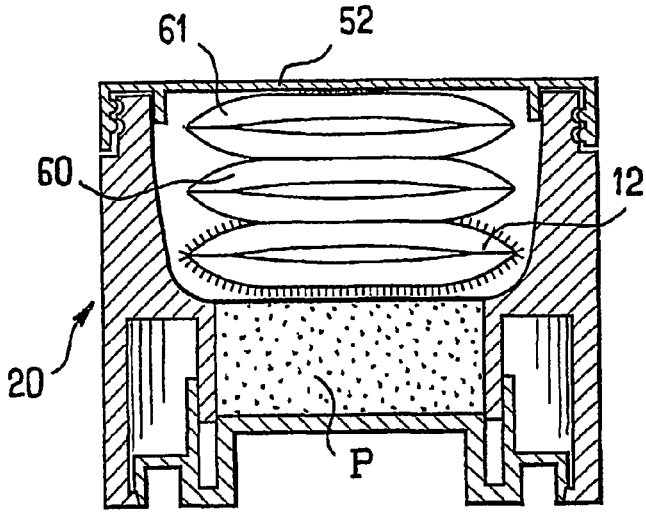
Figure 23:
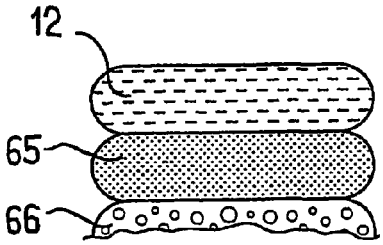
FIG. 23 is a fragmentary view of a support comprising superposed compressible elements presenting differing degrees of compressibility.

The applicator member 12 may be constituted, for example, by assembling together two layers of foam 40 and 41, as described above, and it may be fastened to a support constituted by or including at least one deformable element similar or identical thereto, e.g. a succession of two elements 60 and 61, each element comprising two assembled-together layers of foam defining between them a cavity 42 filled with air. In the example of FIG. 21, the elements 60 and 61 constitute the support and serve as a handle member, and in the example of FIG. 21, the element 61 is fixed to a lid 52 for fastening onto a receptacle, such as the above-described receptacle 20, for example.

The applicator member 12 may be fastened to an axial stack of blocks of different kinds of foam, for example two foam blocks 65 and 66 stuck together, e.g. both having the same height, equal to about 12 millimeters (mm) for example, and both having the same diameter, e.g. equal to about 45 mm. The block 65 being more compressible than the applicator member 12 and the block 66. The block of foam defining the applicator member 12 may be made of polyether, for example, while the block of foam 65 may be made of natural butadiene rubber, and the block of foam 66 may be made of polyurethane.

In the examples described above, the applicator member is separable from the receptacle containing the substance, at least during use.

Figure 24:
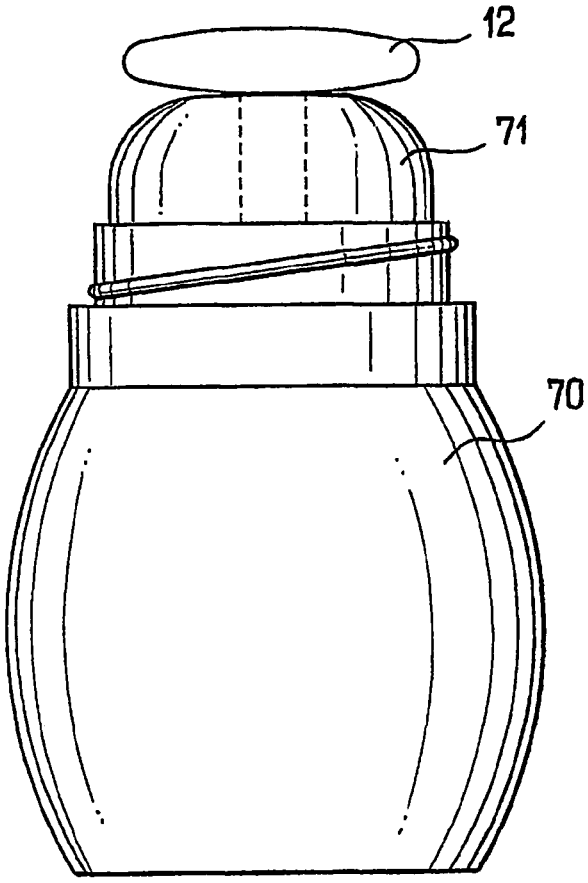
FIGS. 24 and 25 are fragmentary diagrams of two other embodiments of packaging and applicator devices.

It would not go beyond the scope of the present invention for the applicator member to be secured to the receptacle containing the substance during use. By way of example, FIG. 24 shows a device comprising a receptacle 70, e.g. having a compressible wall, carrying at its top end a support-forming portion 71 provided with an orifice for feeding substance that opens out into the face of the applicator member opposite from its face that is used for applying the substance.

The applicator member 12 may be made of a material that is porous to the substance, the substance reaching the application surface by passing through the applicator member.

Figure 25:
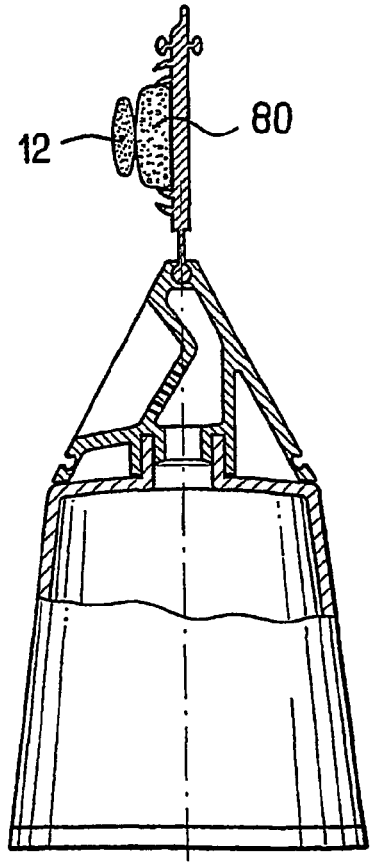

It is also possible for the applicator member 12 to be fixed on a support 80 that is movable relative to the receptacle containing the substance, as shown in FIG. 25. One such structure enabling the applicator member to be moved relative to the receptacle, e.g. by pivoting, is described in French patent application FR 2 814 444, the contents of which is incorporated in the present application by reference.

The applicator member may contribute to obtaining leak-tight closure of the receptacle containing the substance, for example by being pressed against a seat surrounding one or more substance outlet orifices, as can be done for example with the case shown in FIG. 25.

The present invention is not limited to the embodiments described above. In particular, all or some of the characteristics of the preceding embodiment may be combined with one another without going beyond the scope of the present invention. The profile of the edges of the applicator member may present shapes other than those described above. Throughout the description, the term "comprising a" should be understood as being synonymous with "comprising at least one", unless specified to the contrary.

The invention claimed is:

1. A device for applying a substance, the device comprising:

a receptacle;

a support having a first face, said support being releasably engaged with said receptacle in an engagement position; and a compressible applicator member having a peripheral edge and having a second face fastened to said first face, said applicator member extending along one side only of said first face;

said applicator member comprising:

at least one first portion fastened to said support; and at least one second portion surrounding said first portion and spaced apart from said support, said second portion forming with said support an outwardly open empty annular space enabling said applicator member to bend towards said support during application;

wherein said applicator member is positioned between said receptacle and said support in said engagement position.

2. A device according to claim 1, wherein said second face has a profile different from a profile of said first face so that a portion of a peripheral edge of said second face is at a distance from said first face.

3. A device according to claim 1, wherein said compressible applicator member has a shape that is generally flat transversely to an axis (X), and said second portion cooperates with said support when said applicator member is not compressed to define an acute angle in a plane containing said axis (X).

4. The device according to claim 3, wherein said applicator member comprises at least two layers of foam that are assembled together.

5. The device according to claim 4, wherein said applicator member includes at least one interval cavity.

6. The device according to claim 5, wherein said two layers of foam are assembled together so as to form said internal cavity.

7. The device according to claim 4, 5, or 6, wherein said two layers of foam are assembled together by heat-sealing.

8. The device according to claim 4, wherein at least one of said two layers of foam is flocked on the outside.

9. The device according to claim 3, wherein said support comprises a rigid portion having said applicator member fastened thereto.

10. The device according to claim 9, wherein said rigid portion comprises a sintered piece.

11. The device according to claim 3, wherein said support presents a substantially plane face having said applicator member fastened thereto.

12. The device according to claim 3, wherein said acute angle is less than or equal to 60°.

13. The device according to claim 3, wherein said support includes at least one substance feed orifice.

14. The device according to claim 1, wherein said applicator member is deformable so that said second portion bears against said support during application.

15. The device according to claim 1, wherein said applicator member is generally disk-shaped.

16. The device according to claim 1, wherein a surface of said second portion facing said support is outwardly convex.

17. The device according to claim 1, wherein said first portion is situated substantially in a center of said second face of said applicator member.

18. The device according to claim 1, wherein said applicator member is fastened in a non-removable manner to said support.

19. The device according to claim 1, wherein said applicator member is fastened to said support in a removable manner.

20. The device according to claim 1, wherein said applicator member has an application face that is generally convex.

21. The device according to claim 1, wherein said applicator member has an application face that is generally concave.

22. The device according to claim 1, wherein said applicator member has an application face that is substantially planar.

23. The device according to claim 1, wherein said applicator member has a flocked face that is used for application.

24. The device according to claim 1, wherein said support comprises a flexible portion on which said applicator member is fastened.

25. The device according to claim 24, wherein said flexible portion comprises a compressible element.

26. The device according to claim 25, wherein said compressible element comprises at least one layer of foam.

27. The device according to claim 25, wherein said compressible element is hollowed out internally.

28. The device according to claim 24, wherein said flexible portion includes an elastomer wall.

29. The device according to claim 1, wherein said first face generally outwardly convex.

30. The device according to claim 1, wherein said support comprises a hollow part to which said applicator member is fastened.

31. The device according to claim 1, said receptacle containing a substance.

32. The device according to claim 31, wherein said applicator member is compressed when said receptacle is closed.

33. The device according to claim 1, wherein said support is configured to close said receptacle in substantially a leak-tight manner.

34. The device according to claim 1, further comprising a sieve wherein said applicator member comes into contact with said sieve when said receptacle is closed.

35. A device according to claim 1, wherein said first face of said support has an area greater than or equal to an area defined inside said peripheral edge.

* * * * *

UNITED STATES PATENT AND TRADEMARK OFFICE

CERTIFICATE OF CORRECTION

PATENT NO. : 7,611,301 B2
APPLICATION NO. : 10/475461
DATED : November 3, 2009
INVENTOR(S) : Jean-Louis Gueret It is certified that error appears in the above-identified patent and that said Letters Patent is hereby corrected as shown below:

Column 9, line 13, before "generally" insert --is--.

Signed and Sealed this

Twenty-first Day of December, 2010

David J. Kappos

David J. Kappos
*Director of the United States Patent and Trademark Office*